United States Patent [19]

Voss et al.

[11] 4,412,652

[45] Nov. 1, 1983

[54] ECONOMIZER FOR BUILDING HEATING SYSTEMS

[76] Inventors: Herman Voss; Fern E. Voss, both of 155 Vista Ter., Wolf Lake, Muskegon, Mich. 49442

[21] Appl. No.: 238,814

[22] Filed: Feb. 27, 1981

[51] Int. Cl.[3] ..... F24H 3/06

[52] U.S. Cl. ..... 237/16; 237/50; 122/20 A; 122/20 B

[58] Field of Search ..... 122/33, 20 B, 20 A; 237/50, 16; 126/101

[56] References Cited

U.S. PATENT DOCUMENTS

| | | | |
|---|---|---|---|
| 44,597 | 10/1864 | Brayton . | |
| 382,863 | 5/1888 | Bossler . | |
| 482,076 | 9/1892 | Clarke . | |
| 892,352 | 6/1908 | Bixby et al. . | |
| 1,112,583 | 6/1914 | Williams . | |
| 1,591,647 | 7/1926 | Smith | 122/33 |
| 1,665,520 | 4/1928 | Wood . | |
| 2,151,108 | 3/1939 | Hultgren | 122/33 |
| 2,827,893 | 3/1958 | Ribaudo et al. | 126/101 |
| 3,833,170 | 9/1974 | Marshall | 126/101 |
| 4,210,102 | 7/1980 | Dosmann | 126/101 |
| 4,258,878 | 3/1981 | Van Pachtenbeke | 122/20 B |

*Primary Examiner*—William R. Cline
*Assistant Examiner*—John F. McNally
*Attorney, Agent, or Firm*—Price, Heneveld, Huizenga & Cooper

[57] ABSTRACT

An economizer is provided for building heating systems and the like, of the type having a forced air furnace with adjacent combustion and heat exchange chambers, and a hot water reservoir or heater. The economizer comprises lower and upper heat transfer coils shaped for positioning adjacent the combustion and heat exchange chambers respectively of the furnace. An insulated standpipe interconnects the two coils, and the outlet of the upper coil is communicated with the inlet of the water heater. During use, water flowing through the economizer is heated in the lower coil and flowed to the upper coil to transfer additional heat to the air flowing through the heat exchange chamber, and simultaneously preheat water fed into the water heater.

23 Claims, 5 Drawing Figures

ECONOMIZER FOR BUILDING HEATING SYSTEMS

BACKGROUND OF THE INVENTION

The present invention relates to heating systems, and in particular to an economizer therefor.

Heretofore, numerous devices have been proposed to improve the efficiency of heating systems for buildings and the like. However, such devices are typically quite complex, expensive, and not adapted for use in conjunction with forced air furnaces.

SUMMARY OF THE INVENTION

One aspect of the present invention is to provide an economizer for building heating systems and the like, of the type having a hot water reservoir, and a forced air furnace with adjacent combustion and heat exchange chambers. A first heat transfer coil is mounted in the combustion chamber of the furnace at a location disposed generally above the burners. The inlet side of the first heat transfer coil is communicated with a source of water. A second heat transfer coil is mounted adjacent the heat exchange chamber of the furnace, and a standpipe interconnects the first and second coils. The outlet of the second or upper coil is communicated with the inlet of the water heater. During use, water is flowed through the economizer, such that the water is heated in the lower coil by the burners, flowed through the upper coil to transfer additional heat to the air flowing through the heat exchange chamber, and simultaneously heat the water fed into the hot water reservoir.

The principal objects of the present invention are to provide an economizer for improving the efficiency of building heating systems of the type having a forced air furnace and a hot water reservoir or heater. The economizer has an uncomplicated design which is economical to manufacture and install, and is quite safe in operation. The economizer is designed to be installed in a conventional forced air furnace, and is particularly adapted for residential applications.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
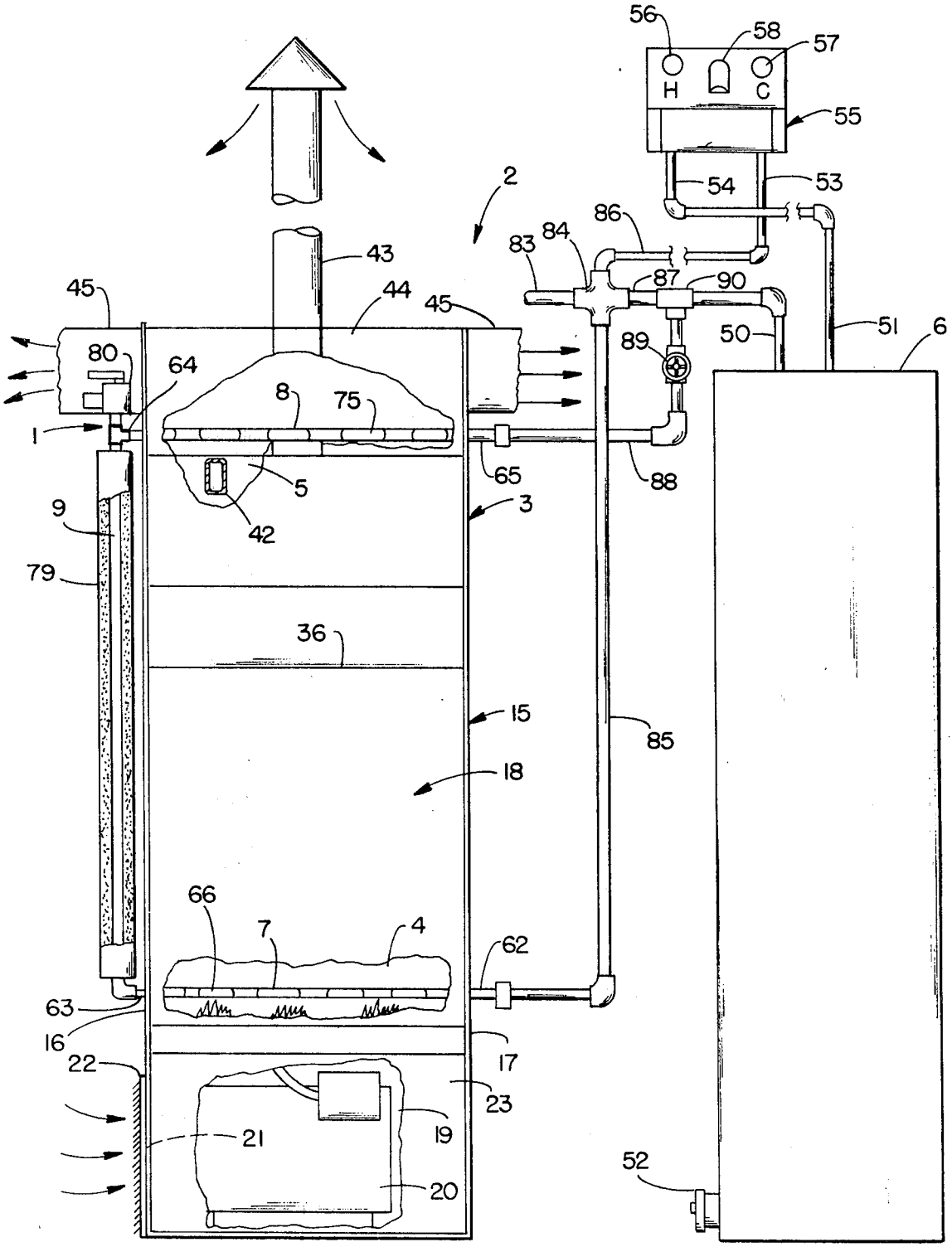
FIG. 1 is a partially schematic side elevational view of an economizer embodying the present invention, shown installed in a building heating system comprising a forced air furnace and a hot water reservoir, wherein portions of the furnace are broken away to reveal internal construction.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 (FIG. 1) generally designates an economizer embodying the present invention, which is adapted for use in building heating systems 2, of the type comprising a forced air furnace 3 with combustion and heat exchange chambers 4 and 5, and including a hot water reservoir 6. Economizer 1 comprises lower and upper heat transfer coils 7 and 8, shaped for positioning adjacent combustion chamber 4 and heat exchange chamber 5 respectively of furnace 3. An insulated standpipe 9 interconnects coils 7 and 8, and the outlet of upper coil 8 is communicated with the inlet of water reservoir 6. During use, water flowing through economizer 1 is heated in lower coil 7, and flowed to upper coil 8 to transfer additional heat to air flowing through heat exchange chamber 5, and simultaneously heat the water fed into reservoir 6.

Economizer 1 is adapted to be used in conjunction with a wide variety of different types of forced air furnaces, including those fired by oil, propane, natural gas, and the like. The illustrated furnace 3 is gas fired, by either natural gas or propane, and with the exception of economizer 1, has a substantially conventional construction, comprising a generally rectangular housing 15, having left and right-hand sidewalls 16 and 17 respectively, and a multi-portion front 18. An air inlet chamber 19 is disposed at the base of housing 15, and includes a blower 20 mounted therein which draws cold return air from the room through an opening 21 in air inlet chamber 19, and forces the air upwardly through heat exchange chamber 5. In this example, air inlet opening 21 is disposed in a side wall of housing 15, and includes a slotted or louvered grill 22 thereover. However, it is to be understood that air inlet opening 21 can also be connected with a cold air return duct (not shown) of the building's heating system. A removable cover panel 23 extends over the front side of air inlet chamber 19, and provides access to blower 20 for maintenance and repair.

Figure 4:
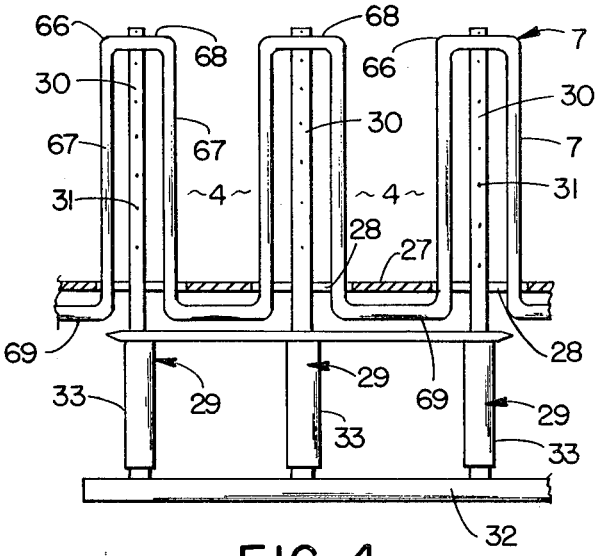
FIG. 4 is a fragmentary, horizontal cross-sectional view of the furnace, showing a lower economizer coil disposed in a combustion chamber of the furnace.
Figure 5:
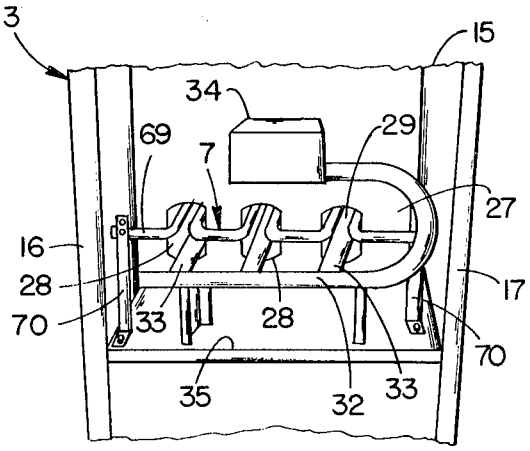
FIG. 5 is a fragmentary, front perspective view of the furnace, particularly showing the lower coil of the economizer installed therein.

The combustion chamber 4 of furnace 3 is disposed directly above air inlet chamber 19, and as best illustrated in FIGS. 4 and 5, includes a front panel 27 with a plurality of openings 28 therein in which fuel mixing tubes 29 are received. A burner 30 (FIG. 4) having a plurality of longitudinally spaced orifices 31 is disposed at the end of each mixing tube 29. Gas is supplied to each mixing tube 29 through a header 32, and is mixed with air in sleeves 33 before entering the burner 30. A remotely controlled shutoff valve 34 (FIG. 5) is mounted at the inlet of header 32, and selectively controls the flow of gas therethrough. Burners 30 operate in a conventional fashion, with the fuel and air mixture being expelled through orifices 31 and ignited, thereby producing heat energy which is transferred to heat exchange chamber 5 by convection and radiation. The mixing tubes 29 and lower coil 7 are supported on a base plate or ledge 35 of housing 15, and a removable cover plate 36 (FIG. 1) closes the middle portion of the housing front.

Figure 2:
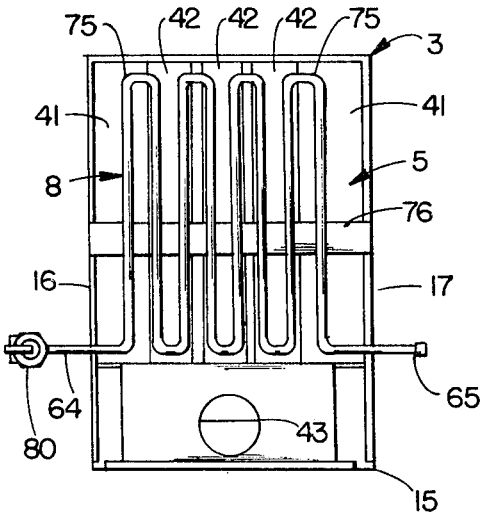
FIG. 2 is a top plan view of the economizer, shown installed in the furnace.

With reference to FIG. 1, the heat exchange chamber 5 of furnace 3 is located at the top of housing 15, and communicates with air inlet chamber 19. As best illustrated in FIG. 2, the illustrated furnace 3 includes vertically extending air passageways 41 through which cold return air from air inlet chamber 19 is forced by blower 20. The hot exhaust gases produced from burners 30 rise through a plurality of transversely extending heat exchange tubes 42. The exhaust gases exit at the upper ends of heat exchange tubes 42 through a duct 43, and are typically vented to the outside of the building. The air flowing through passageways 41 is heated by tubes 42, and empties into and is distributed from a plenum chamber 44 (FIG. 1). Plenum chamber 44 has a hollow, rectangular body, with an open end disposed directly above heat exchange chamber 5. Hot air ducts 45 are communicated with plenum chamber 44, and carry the heated air to registers (not shown) throughout the building.

Water reservoir 6 broadly comprises an insulated container or tank in which hot water can be stored. Preferably, reservoir 6 is a hot water heater with an internal heater to facilitate year-round operation. The illustrated water heater 6 is of a conventional construction, and includes an insulated tank with a cold water inlet 50, and a hot water outlet 51 at the upper end of the unit. The water heater inlet 50 and outlet 51 are attached in a conventional fashion with plumbing which transports hot and cold water to the various utilities throughout the building, such as the illustrated sink or washstand 55. Plumbing conduits 53 and 54 supply water to the cold and hot valves 56 and 57 of mixer 58.

Figure 3:
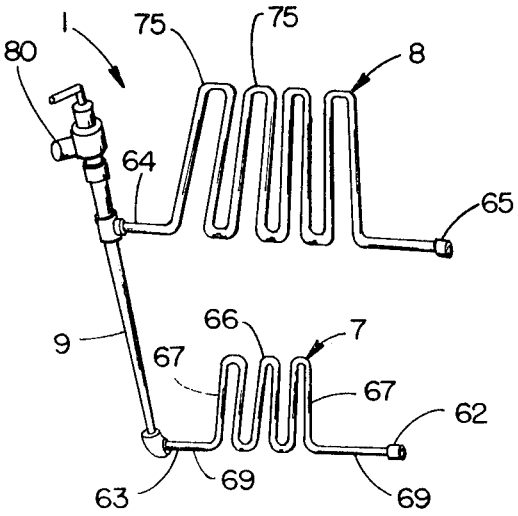
FIG. 3 is a perspective view of the economizer.

With reference to FIG. 3, lower heat transfer coil 7 includes an inlet end 62 and an outlet end 63, and in a similar fashion, upper coil 8 includes inlet end 64, and outlet end 65. Both heat transfer coils 7 and 8 comprise a conductive tube bent into a surpentine shape with a substantially planar configuration adapted for assuming a generally horizontal orientation in the associated portion of furnace 3. In this example, the tube shape of both coils 7 and 8 comprises a plurality of U-shaped loops 66, arranged in a regular configuration. The number of loops 66 in lower coil 7 preferably corresponds to the number of heat exchange chamber openings 28. Also, each loop 66 has a width and is spaced from its adjacent loop a distance adapted for insertion through openings 28, as best illustrated in FIGS. 4 and 5. In the structure illustrated in FIG. 4, the legs 67 of each conduit loop 66 extend on opposite sides of the burner 30, positioned therebelow, with conduit ends 68 extending laterally across burner 30 adjacent the interior end thereof. As best illustrated in FIG. 5, the exterior ends 69 of the left and right-hand loops 66 are connected with brackets 70, which mount the economizer coils securely in place in the furnace. The inlet 62 and outlet 63 of the illustrated lower coil 7 are substantially coaxial to facilitate installation.

Upper heat transfer coil 8 (FIGS. 2 and 3) includes four U-shaped loops 75, and is otherwise substantially identical with the above described lower coil 7. In the illustrated heating system, there is no room in the upper end of furnace combustion chamber 5 in which the upper economizer coil 8 can be mounted. Hence, upper coil 8 (FIG. 2) is positioned in the lower portion of plenum chamber 44, at a location just above the outlet opening of heat exchange chamber 5. Upper coil 8 is supported on a cross brace 76 which extends transversely between housing side walls 15 and 16, and is centered over the outlet of chamber 5, such that partially heated air exiting from heat exchange chamber 5 passes over coil 8 as it flows into plenum chamber 44. It is to be understood that upper heat transfer coil 8 can be mounted in virtually any portion of the heat exchange chamber 5, or any portion of the furnace which communicates with heat exchange chamber 5. The illustrated arrangement is an adaptation for conventional gas forced air furnaces, and the lower portion of plenum chamber 44 functions like an extension of heat exchange chamber 5.

With reference to FIG. 1, standpipe 9 communicates the outlet end 63 of lower coil 7 with the inlet end 64 of upper coil 8. In this example, standpipe 9 is approximately three feet long, and extends outside of the furnace 3, along exterior sidewall 16 to facilitate ease of installation in conventional furnaces. An insulative sleeve 79 covers standpipe 9 to reduce heat loss. A safety relief valve 80 is attached to the uppermost end of standpipe 9, and automatically opens to discharge excess pressure from the economizer when the pressure therein exceeds a predetermined level. Preferably, the entire economizer, including coils 6 and 7 and standpipe 9, is constructed of a conductive and corrosion-resistant material, such as ½-inch copper tubing.

Economizer 1 can be used to retrofit existing residential forced air furnaces in the following manner. Two apertures are formed in side walls 16 and 17 of furnace housing 15 adjacent the base thereof to mate with the inlet and outlet ends 62 and 63 of lower coil 7. In a similar manner, two apertures are formed in the side walls of plenum chamber 40 to receive the inlet and outlet ends 64 and 65 of upper coil 8 therethrough. The loops 66 of lower coil 7 are inserted into the openings 28 of combustion chamber wall 27, and are centered over the corresponding burners 30. Brackets 70 are attached to housing ledge 36, and mount lower coil 7 in a substantially horizontal position over burners 30. Plenum chamber 44 is removed from the top of furnace housing 15 a distance sufficient to insert upper coil 8 into the chamber, with the inlet and outlet ends projecting through the mating apertures. Standpipe 9 is then attached to outlet end 63 of lower coil 7 and inlet end 64 of upper coil 8 by means such as soldering or the like.

Forced air furnace 3, with economizer 1 installed therein, is connected with the building heating system in the following manner. The inlet end 62 of lower coil 7 is communicated with a source of cold, potable water, such as a well, city water, or the like, which is schematically designated in FIG. 1 as being introduced through line 83. In the illustrated example, water inlet line 83 is connected with a four-way union 84, having one side thereof communicating with lower coil inlet end 62 through conduit 85. The opposite side of union 84 is communicated with the cold water valve 57 of sink 55 by a pipe or conduit 86. The remaining side of union 45 is communicated with the inlet 50 of water heater 6 by a conduit 87. The outlet end 65 of upper coil 8 is communicated with water heater inlet 50 by a conduit 88, which is connected by T-fitting 90 at a medial portion of conduit 87, downstream of inlet pipe 83, and includes a valve 89 disposed therein.

In operation, cold, potable water flows into the heating system 2 through supply line 83. When hot water is withdrawn from water heater 6, such as by opening sink valve 56, a pressure differential is created in water heater inlet 50, which causes cold water to flow from supply line 83, through conduit 85, and into the inlet end 62 of lower coil 7. When the combustion chamber 4 is hot, such as during or just after ignition of burners 30, lower coil 7 and water therein are heated, so that the lower coil acts as a heat absorber. The heated water then flows upwardly through standpipe 9 into and through coil 8, thereby heating the conductive tubing of upper coil 8. When the blower 20 of furnace 3 is operating, the heated air exiting from heat exchange chamber 5 of furnace 3 passes over upper coil 8, and additional heat is imparted to the air by coil 8, such that upper coil 8 acts as a radiator. The heated water then exits coil 8 into the inlet 50 of water heater 6, whereby the water entering water heater 6 is preheated by economizer 1. Since T-joint 90 is located downstream of union 84, the majority of cold incoming water passes through economizer 1. In the summer when furnace 3 is not operating, the user simply closes valve 87, thereby preventing water from flowing through economizer 1, and permitting the supply of cold water to flow directly into water heater 6. Selected manipulation of valve 87 also regulates or varies the amount of water flowing through economizer 1.

Economizer 1 has a quite uncomplicated design which is economical to manufacture and install, even in existing forced air furnaces. Economizer 1 improves the efficiency of building heating systems, and is particularly adapted for conventional, residential installations.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a heating system for buildings having a conventional, forced-air furnace and a hot water reservoir, wherein said conventional furnace has a combustion chamber with burners mounted therein, and a heat exchange chamber through which air is flowed and heated by said burners, the improvement of an economizer, comprising:

a first heat transfer coil, having inlet and outlet sides, and being mounted in communication with the combustion chamber of said furnace;

means for communicating the inlet side of said first heat transfer coil with a source of water;

a second heat transfer coil, having inlet and outlet sides, and being mounted in communication with the heat exchange chamber of said furnace;

means for communicating the outlet side of said first heat transfer coil with the inlet side of said second heat transfer coil, and comprising an insulated standpipe extending along an exterior side of said conventional furnace;

means for communicating the outlet side of said second heat transfer coil with an inlet side of said hot water reservoir; and means for selectively flowing water from said source through said economizer, whereby during operation, the water is heated in said first heat transfer coil by said burners, and flowed through said second heating coil to transfer additional heat to the air flowing through said heat exchange chamber and simultaneously heat the water fed into said water reservoir.

2. A heating system as set forth in claim 1, wherein:

said water reservoir comprises a hot water heater, whereby said economizer preheats the water fed into said water heater.

3. A heating system as set forth in claim 2, wherein:

said first heat transfer coil is mounted in the combustion chamber of said furnace at a location disposed generally above said burners.

4. A heating system as set forth in claim 3, wherein:

said furnace is gas fired.

5. A heating system as set forth in claim 4, wherein:

said first heat transfer coil comprises a conductive tube bent into a surpentine shape with a substantially planar configuration adapted for assuming a generally horizontal orientation in the combustion chamber of said furnace.

6. A heating system as set forth in claim 5, wherein:

said second heat transfer coil comprises a conductive tube bent into a serpentine shape with a substantially planar configuration adapted for assuming a generally horizontal orientation adjacent the heat exchange chamber of said furnace.

7. A heating system as set forth in claim 6, including:

a pressure relief valve connected with said standpipe.

8. A heating system as set forth in claim 7, wherein:

said combustion chamber includes a side wall with a plurality of openings therethrough in which mixing tubes for said burners are positioned; and said tube shape of said first heat transfer coil comprises a plurality of U-shaped loops, sized for insertion into the side wall openings of said combustion chamber.

9. A heating system as set forth in claim 8, wherein:

said hot water heater has a conventional construction.

10. A heating system as set forth in claim 9, including:

a valve positioned in said means communicating the outlet side of said second heat transfer coil with the inlet side of said hot water reservoir, and regulating the flow of water through said economizer.

11. A heating system as set forth in claim 10, wherein:

said furnace includes a plenum chamber disposed directly above and communicating with the outlet of said heat exchange chamber; and said second heat transfer coil is mounted in a base portion of said plenum chamber.

12. A heating system as set forth in claim 1, wherein:

said second heat transfer coil is mounted in said heat exchange chamber.

13. A heating system as set forth in claim 1, wherein:

said furnace is gas fired.

14. A heating system as set forth in claim 1, wherein:

said first heat transfer coil comprises a conductive tube bent into a surpentine shape with a substantially planar configuration adapted for assuming a generally horizontal orientation in the combustion chamber of said furnace.

15. A heating system as set forth in claim 14, wherein:

said combustion chamber includes a side wall with a plurality of openings therethrough in which mixing tubes for said burners are positioned; and said tube shape of said first heat transfer coil comprises a plurality of U-shaped loops, sized for insertion into the side wall openings of said combustion chamber.

16. A heating system as set forth in claim 1, wherein:

said second heat transfer coil comprises a conductive tube bent into a surpentine shape with a substantially planar configuration adapted for assuming a generally horizontal orientation adjacent the heat exchange chamber of said furnace.

17. A heating system as set forth in claim 1, including:

a pressure relief valve connected with said standpipe.

18. An economizer for building heating systems of the type having a conventional forced air furnace and a water heater, wherein said conventional furnace has a combustion chamber with burners mounted therein, and a heat exchange chamber through which air is flowed and heated by said burners, said economizer comprising:

a first heat transfer coil, having inlet and outlet sides, and being adapted for mounting in the combustion chamber of the furnace at a location disposed generally above the burners;

means for communicating the inlet side of said first heat transfer coil with a source of water;

a second heat transfer coil, having inlet and outlet sides, and being adapted for mounting in communication with the heat exchange chamber of the furnace;

means for communicating the outlet side of said first heat transfer coil with the inlet side of said second heat transfer coil, and comprising an insulated standpipe extending along an exterior side of the conventional furnace; and means for communicating the outlet side of said second heat transfer coil with an inlet side of the water heater, whereby during operation, water from the source is heated in said first heat transfer coil by the burners, and flowed through said second heating coil to transfer additional heat to the air flowing through the heat exchange chamber and simultaneously preheat the water fed into the water heater.

19. An economizer as set forth in claim 18, wherein: said second named communicating means comprises an insulated standpipe adapted to extend along an exterior side of the furnace.

20. An economizer as set forth in claim 19, wherein: said first heat transfer coil comprises a conductive tube bent into a surpentine shape with a substantially planar configuration adapted for assuming a generally horizontal orientation in the combustion chamber of the furnace.

21. An economizer as set forth in claim 20, wherein: said second heat transfer coil comprises a conductive tube bent into a surpentine shape with a substantially planar configuration adapted for assuming a generally horizontal orientation above the heat exchange chamber of the furnace.

22. An economizer as set forth in claim 21, including: a pressure relief valve connected with said standpipe.

23. An economizer as set forth in claim 22, wherein: said tube shape of said first heat transfer coil comprises a plurality of U-shaped loops, sized for insertion into mixing tube openings in a side wall of said combustion chamber.

* * * * *